United States Patent [19]

Bobbola

[11] Patent Number: 4,592,394

[45] Date of Patent: Jun. 3, 1986

[54] OPTICAL WEFT SENSOR FOR AIR JET WEAVING LOOMS

[75] Inventor: Paolo Bobbola, Vigliano Biellese, Italy

[73] Assignee: Roj Electrotex S.p.A., Biella, Italy

[21] Appl. No.: 659,562

[22] Filed: Oct. 10, 1984

[30] Foreign Application Priority Data

Oct. 10, 1983 [IT] Italy ..... 23231 A/83

[51] Int. Cl.[4] ..... D03D 51/34

[52] U.S. Cl. ..... 139/370.1

[58] Field of Search ..... 139/370.2, 370.1; 250/561

[56] References Cited

U.S. PATENT DOCUMENTS

| | | | |
|---|---|---|---|
| 3,853,408 | 12/1974 | Kaalverink | 139/370.2 |
| 4,021,119 | 5/1977 | Stauffer | 250/561 |
| 4,432,399 | 2/1984 | Bachmann | 139/370.2 |
| 4,471,816 | 9/1984 | Wada | 139/370.2 |

*Primary Examiner*—Henry S. Jaudon

*Attorney, Agent, or Firm*—Young & Thompson

[57] ABSTRACT

An optical sensor of the barrier type for air jet weaving looms comprises two equally orientated, parallel photoelements and two very thin total-transmission optical prisms aligned with the photoelements and insertable between and the reed blades in order to deviate the light rays between the photoelements so that they cross the weft yarn passage channel in the reed.

1 Claim, 2 Drawing Figures

OPTICAL WEFT SENSOR FOR AIR JET WEAVING LOOMS

BACKGROUND OF THE INVENTION

Currently used electronic devices for monitoring weft yarn breakage in air jet weaving looms comprise at least one optoelectronic detector disposed in such a manner as to sense that the yarn has been correctly inserted. More exacly, the detector in question, disposed in the profiled loom reed at the predetermined height, senses the presence of the weft yarn when the free front end of said yarn, during insertion into the shed, reaches its sensitive field and passes through it.

The practical embodiments of such devices used up to the present time operate in accordance with the following general principles:

(a) by reflection on the yarn: in this case, the optoelectronic detector is constituted by an emitter element and a photosensitive element which are disposed in such a manner as to create a sensitive zone along the yarn passage channel in the reed, the state of this zone being disturbed by the passage of said yarn;

(b) optical barrier principle: in this case, two opposing photoelement face the yarn passage channel in the reed, and the weft yarn interrupts the sensitive field when it crosses it.

Both these systems have certain drawbacks. In particular, because of the physical dimensions of the photoelements, the optical barrier system requires the reed to be cut at the zone into which it is inserted, this involving high operating costs because even for slightly different manufactured fabric heights and/or loom heights it is necessary to use different reeds. The reflection system does not suffer from the said drawback because the detector is outside the reed. It is however more delicate in operation and of low overall reliability, in that it utilises light reflection by the yarn and not all yarns reflect in the same manner. In fact some of them (in particular black, opaque and similar yarns) reflect very little, to such an extent that the disturbance produced is minimal and cannot be detected.

SUMMARY OF THE INVENTION

The present invention proposes to obviate all these drawbacks by means of an optical weft sensor of the optical barrier type, characterised by comprising two equally orientated, parallel photoelements and two very thin total-transmission optical prisms aligned with the photoelement and insertable between the reed blades in order to deviate the light rays between said photoelements so that they cross the weft yarn passage channel in the reed.

Preferably the thin optical prisms are fixed rigidly to a casing external to the reed and associable with it, and which also houses the photosensitive elements and from which said prisms project so that they can be inserted in the required position between two reed blades of the loom to be monitored.

BRIEF DESCRIPTION OF THE DRAWINGS

The invention is described in greater detail hereinafter with reference to the accompanying drawings, which show a preferred embodiment thereof, and in which.

DESCRIPTION OF THE PREFERRED EMBODIMENTS

With reference to the drawings, the sensor according to the invention comprises two photoelements 1 and 2 disposed parallel to each other and equally orientated, and two extra-thin total-transmission optical prisms 3 and 4 aligned with said elements 1 and 2.

Figure 1:
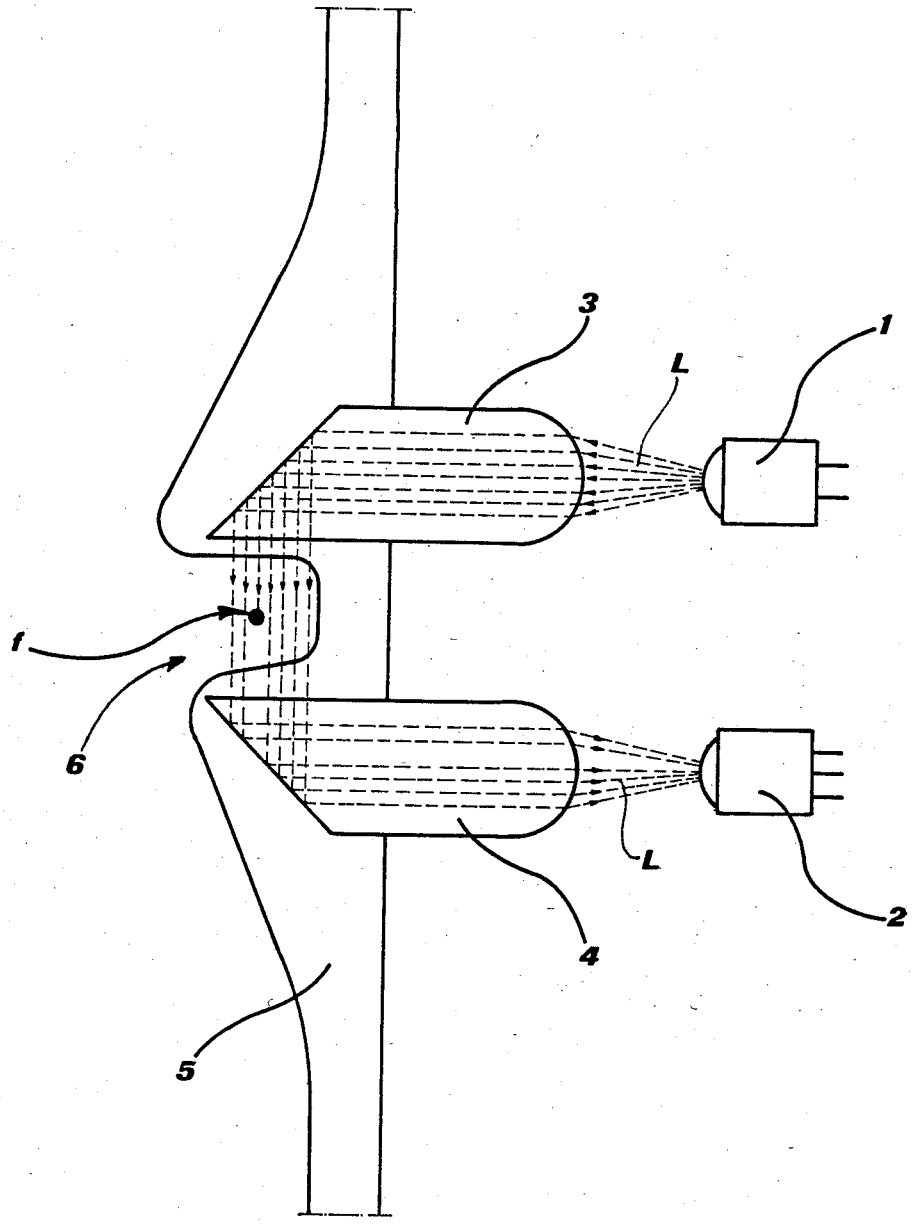
FIG. 1 is a detailed scheme of the arrangement according to the invention, which illustrates its operation.

As can be clearly seen from FIG. 1, if the prisms 3 and 4 are inserted between two adjacent blades 5 of a loom reed (as is possible by virtue of their very small thickness) the light beam L leaving the emitter 1 is deviated by the prism 3 so that it crosses the reed channel 6 through which the weft yarn f passes, and is then received by the prism 4 and deviated onto the photosensitive element 2 parallel to itself.

Any yarn f which passes through the optical barrier thus created in the channel 6 or moves therein within the reed gives rise to a strong field variation which is used for monitoring the yarn presence by known methods. The operating characteristics of the device thus depend neither on the colour nor on the type of yarn to be sensed, and the sensor can be shifted along the reed without problems as the height of the fabric and/or loom varies.

Figure 2:
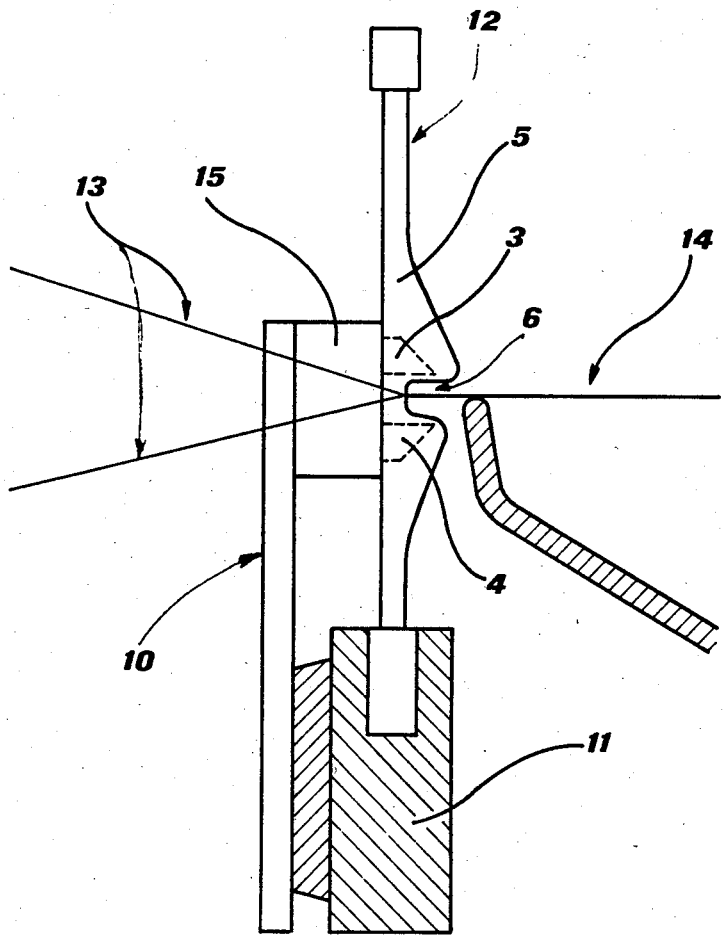
FIG. 2 shows the sensor according to the invention applied to a loom reed.

FIG. 2 shows the sensor 10 according to the invention fitted to a weaving loom, of which the sley 11, reed 12, shed 13 and fabric under formation 14 can be seen.

The sensor comprises a casing 15 which internally houses the two photoelements 1 and 2 and from which the two thin prisms 3 and 4 rigidly fixed to it project. As can be seen, the sensor casing 15 is mounted outside the reed 12 in such a manner that the two prisms 3 and 4 become inserted between two adjacent blades 5, preferably subjected to elastic deformation, of the reed 12 above and below the reed channel 6 through which the weft yarn involved in the weaving passes.

It is apparent that with this type of mounting, the sensor can be applied at various points of the reed so that it can be adapted to the various scheduled fabric and/or loom heights. Where necessary or desirable, it is also possible to apply more than one weft sensor of the type according to the invention to the same loom reed.

The sensor has been described and illustrated only by way of example, and other embodiments or modifications thereto are fully covered by the scope of the present invention.

I claim:

1. In combination with the loom reed of an air jet weaving loom, the reed having a plurality of adjacent blades each having a recess forming part of a loom reed channel through which a weft yarn passes, a casing outside the reed, two equally oriented parallel photoelements in the casing, and two very thin total-transmission optical prisms supported on the casing and extending outside the casing between two adjacent blades and disposed on opposite sides of said channel and so arranged as to guide light rays from one of said photoelements across said channel and then to the other of said photoelements.

* * * * *